US008512004B2

(12) United States Patent
Nakagawa et al.

(10) Patent No.: US 8,512,004 B2
(45) Date of Patent: Aug. 20, 2013

(54) PROPELLER FAN

(75) Inventors: Suguru Nakagawa, Sakai (JP); Zhiming Zheng, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 879 days.

(21) Appl. No.: 12/668,158

(22) PCT Filed: Jul. 11, 2008

(86) PCT No.: PCT/JP2008/062623
§ 371 (c)(1),
(2), (4) Date: Jan. 7, 2010

(87) PCT Pub. No.: WO2009/008513
PCT Pub. Date: Jan. 15, 2009

(65) Prior Publication Data

US 2010/0322779 A1 Dec. 23, 2010

(30) Foreign Application Priority Data

Jul. 11, 2007 (JP) ..... 2007-181639

(51) Int. Cl.
*F01D 5/20* (2006.01)

(52) U.S. Cl.
USPC ..... 416/228; 416/235; 415/173.1

(58) Field of Classification Search
USPC ..... 416/228; 415/119, 222
See application file for complete search history.

(56) References Cited

U.S. PATENT DOCUMENTS

| | | | | |
|---|---|---|---|---|
| 2,899,128 | A * | 8/1959 | Vaghi | 415/222 |
| 4,274,806 | A * | 6/1981 | Gallardo, Jr. | 415/173.4 |
| 6,899,525 | B2 * | 5/2005 | Vanmoor | 416/223 R |
| 7,136,285 | B1 * | 11/2006 | Herbert | 361/695 |
| 7,484,937 | B2 * | 2/2009 | Johann | 416/228 |
| 8,083,487 | B2 * | 12/2011 | Wood et al. | 416/223 R |
| 2010/0329879 | A1 * | 12/2010 | Presz et al. | 416/228 |

FOREIGN PATENT DOCUMENTS

| | | | |
|---|---|---|---|
| JP | 55-7982 | A | 1/1980 |
| JP | 5-44695 | A | 2/1993 |
| JP | 5-149295 | A | 6/1993 |
| JP | 10-159796 | A | 6/1998 |
| JP | 2006-200457 | A | 8/2006 |

* cited by examiner

*Primary Examiner* — Nathaniel Wiehe
*Assistant Examiner* — Alonzo N Coleman
(74) *Attorney, Agent, or Firm* — Birch, Stewart, Kolasch & Birch, LLP.

(57) ABSTRACT

A propeller fan has a gap between a bellmouth and each blade tip. A leakage flow is thus produced from a positive pressure surface of a blade toward a negative pressure surface of the blade via the gap. The leakage flow develops while flowing from the leading edge of each blade toward the trailing edge, thus forming a blade tip vortex. This increases blowing noise and raises the input of the fan motor. In order to suppress the blade tip vortex caused by the leakage flow, the present invention includes recessed portions and projected portions, which are alternately formed in a portion of a blade surface of each blade corresponding to the blade tip.

6 Claims, 10 Drawing Sheets

PROPELLER FAN

TECHNICAL FIELD

The present invention relates to a propeller fan that is improved so as to suppress a blade tip vortex.

BACKGROUND ART

A typical propeller fan has a gap between the bellmouth and the blade tips. A leakage flow thus occurs from a positive pressure surface of a blade to a negative pressure surface of the blade via the gap. As illustrated in FIG. 15, for example, the leakage flow develops while moving from the leading edge toward the trailing edge of the blade and forms a blade tip vortex having a spiral shape. The blade tip vortex increases the blowing noise and raises the input of a fan motor. In FIG. 15, the reference numeral 1 represents a hub and the reference numeral 2 represents a blade. The reference numeral 2*a* represents a leading edge of the blade 2, the reference numeral 2*b* represents a trailing edge of the blade 2, and the reference numeral 2*c* represents a blade tip of the blade 2.

Patent Document 1 discloses a diagonal flow fan having a rib formed on the positive pressure surface of a portion of each blade tip that is not surrounded by the bellmouth. The height of the rib becomes gradually greater from the inlet side toward the outlet side. In this case, some of the air flow introduced from the inlet side is prevented from moving along the blade positive pressure surface and being blown out via the portion of the blade tip that is not surrounded by the bellmouth. This improves the air blowing performance and reduces the blowing noise. However, the technical problem that is to be solved by the invention of Patent Document 1 is basically related to a radially outward flow of a diagonal flow fan, but is not suppression of a blade tip vortex. In addition, the invention described in Patent Document 1 does not necessarily suppress the blade tip vortex effectively.

Further, in order to form the above-described rib on each blade, restriction is set on the blade in terms of the shape of the blade tip. Also, if the rib is formed on the blade, the rib influences the blowing characteristics of each blade and disadvantageously increases the weight of the blade.

Patent Document 1: Japanese Laid-Open Patent Publication No. 5-44695 (see pages 2 and 3 of Description and FIGS. 1 and 2)

DISCLOSURE OF THE INVENTION

Accordingly, it is an objective of the present invention to provide a propeller fan that reliably and effectively suppresses a blade tip vortex generated by a leakage flow.

To achieve the foregoing objective and in accordance with one aspect of the present invention, a propeller fan including a hub, a plurality of blades extending from the hub, and a bellmouth inside which the hub and the blades are arranged is provided. Recessed portions and projected portions are alternately formed in a portion of a blade surface of each blade, which portion corresponds to a blade tip of the blade.

BEST MODE FOR CARRYING OUT THE INVENTION

First Embodiment

FIGS. 1 to 5 show a propeller fan according to a first embodiment of the present invention, which is an air blower of an outdoor unit of an air conditioner.

Figure 1:
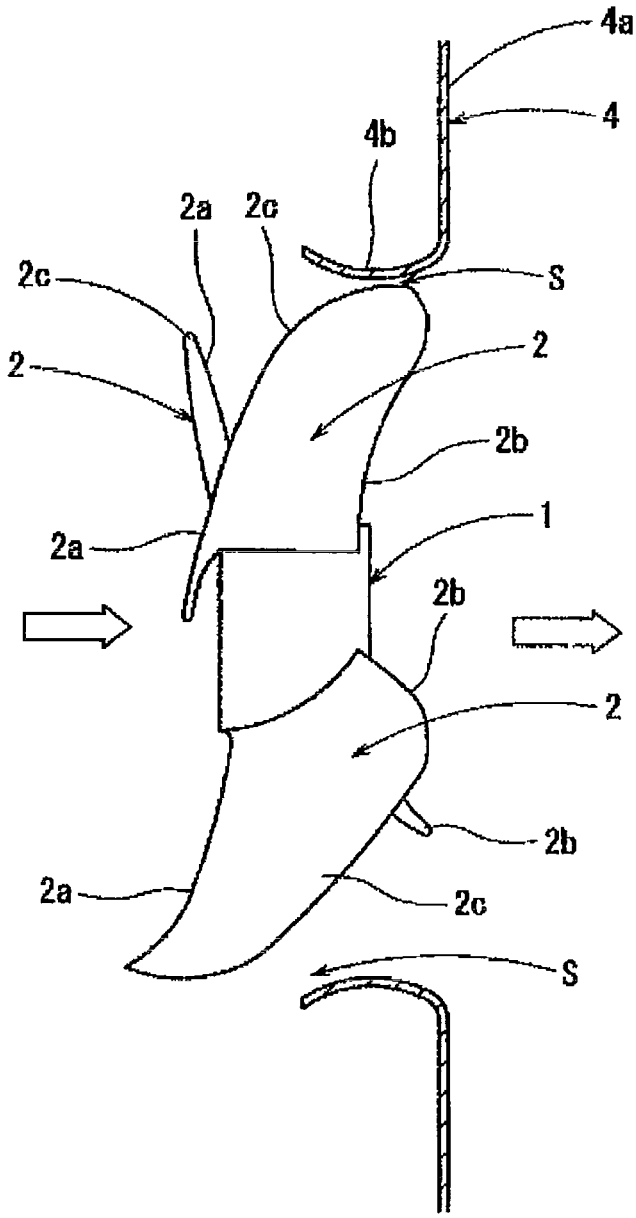
FIG. 1 is a central longitudinal cross-sectional view showing a propeller fan according to a first embodiment of the present invention.
Figure 2:
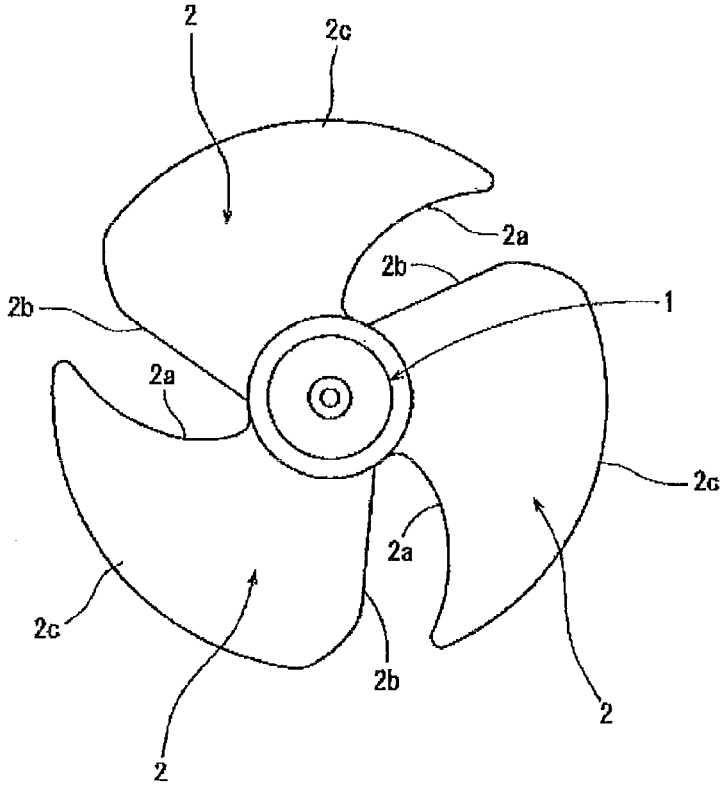
FIG. 2 is a rear view showing the hub and blades of the propeller fan illustrated in FIG. 1, as viewed from the side corresponding to the blade negative pressure surfaces.

In FIGS. 1 and 2, the reference numeral 1 represents a cylindrical hub formed of synthetic resin including a rotational axis of the propeller fan. A plurality of (in the first embodiment, three) blades 2 are arranged on the outer circumferential surface of the hub 1 and formed integrally with the hub 1.

A blade portion formed by the hub 1 and the blades 2 are arranged inside the bellmouth 4. The bellmouth 4 includes a cylindrical air flow guide portion 4*b* and a partition plate portion 4*a*, which is arranged around the guide portion 4*b*. A gap S exists between the inner circumferential surface of the guide portion 4*b* of the bellmouth 4 and a blade tip 2*c* of each of the blades 2.

A leading edge 2*a* of each blade 2 is structured such that its distal portion (the outer portion) is located forward in the rotational direction of the blade 2 from its proximal portion (the inner portion). Similarly, a trailing edge 2*b* of each blade 2 is structured such that its distal portion is located forward in the rotational direction of the blade 2 from its proximal portion.

Figure 3:
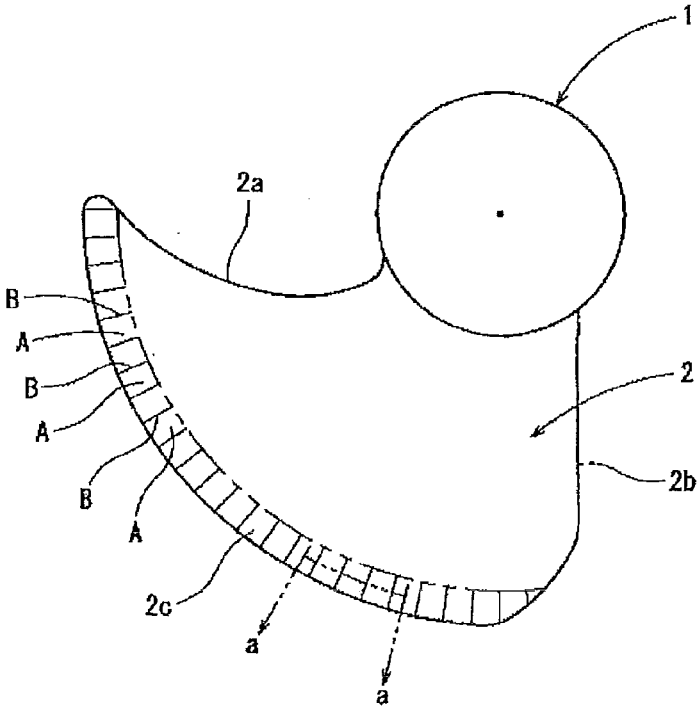
FIG. 3 is a rear view showing a blade of the propeller fan illustrated in FIG. 1, as viewed from the side corresponding to the blade negative pressure surfaces.
Figure 4:
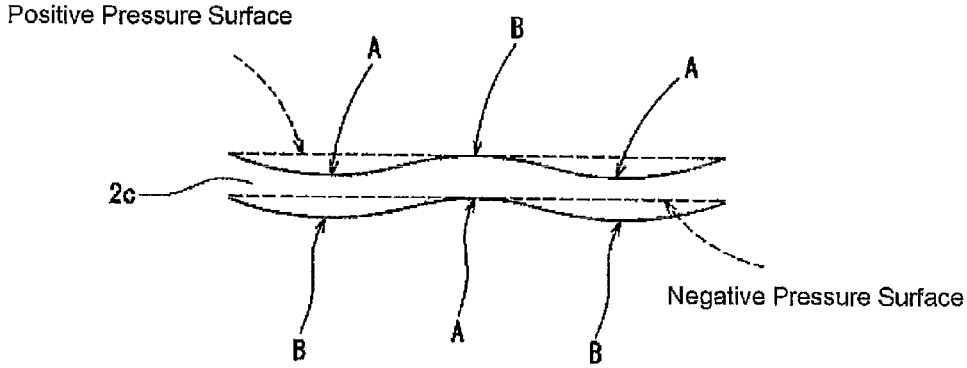
FIG. 4 is a cross-sectional view taken along line a-a of FIG. 3.
Figure 5:
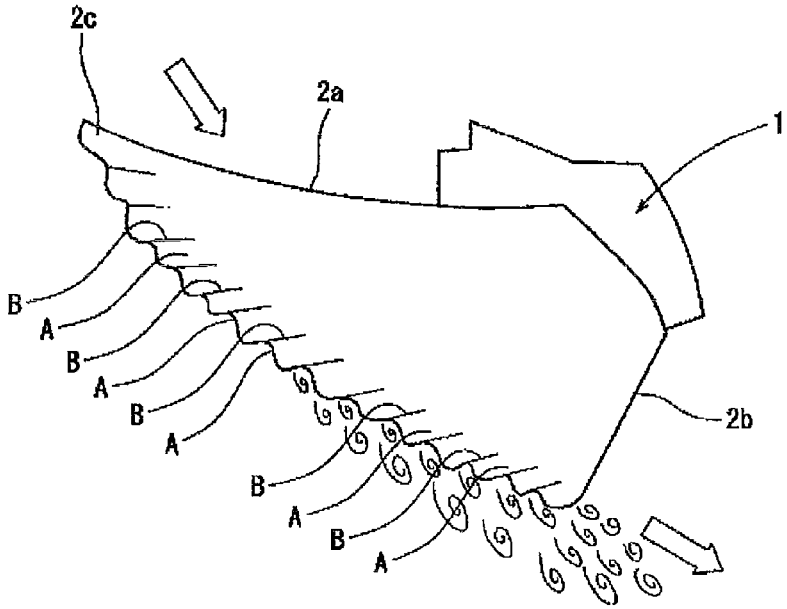
FIG. 5 is a perspective view showing a blade of the propeller fan illustrated in FIG. 1.

As illustrated in FIGS. 3 to 5, the blade tip 2*c* of each blade 2 has a corrugated shape. More specifically, each blade 2 has blade surfaces, which are a positive pressure surface and a negative pressure surface. In portions of these surfaces corresponding to the blade tip 2*c*, recessed portions A and projected portions B are formed alternately along the direction in which the blade tip 2*c* extends. The recessed portions A and the projected portions B, which alternate one another, are arranged continuously from the leading edge 2*a* to the trailing edge 2*b*. The depths of the recessed portions A, which are provided in both of the positive pressure surface and the negative pressure surface of each blade 2, are equal. Similarly, the heights of the projected portions B, which are provided in both of the positive pressure surface and the negative pressure surface of each blade 2, are equal.

The line extending along the deepest parts of each recessed portion A is parallel with a line connecting a point on the line along the deepest parts to the center of the hub 1. The line extending along the highest parts of each projected portion B is parallel with a line connecting a point on the line along the highest parts to the center of the hub 1. The lines each extending along the deepest parts of a corresponding one of the recessed portions A, which recessed portions A are formed on both of the positive pressure surface and the negative pressure surfaces of each blade 2, have the same length. Similarly, the lines each extending along the highest parts of a corresponding one of the projected portions B, which projected portions B are provided on both of the positive pressure surface and the negative pressure surface of each blade 2, have the same length. In other words, the portion of each blade 2 forming the corrugated shape has a constant width along the direction in which the blade tip 2*c* extends.

As illustrated in FIG. 4, the recessed portions A and the projected portions B of each blade tip 2*c* are formed by deforming portions of the blade tip 2*c* that are spaced apart at predetermined intervals along the direction in which the blade tip 2*c* extends in such a manner that these portions project toward the negative pressure surface.

Since the blade tip 2*c* of each blade 2 has the corrugated shape as has been described, a leakage flow moving from the positive pressure surface to the negative pressure surface of the blade 2 via the gap S between the bellmouth 4 and the blade tip 2*c* forms minutely divided, intermittent, and small-scale vortexes as illustrated in FIG. 5. This prevents the leakage flow via the gap S from developing while moving from the leading edge 2*a* to the trailing edge 2*b* of each blade 2 to form a large-scale blade tip vortex. The fan noise is thus reduced. Also, the load on actuation of a fan motor decreases, and the input of the fan motor is lowered.

The cross-sectional shape of each recessed portion A and the cross-sectional shape of each projected portion B may be angular or round. If the recessed portions A and the projected portions B have angular cross-sectional shapes, the minutely divided vortexes are produced efficiently. Contrastingly, if the recessed portions A and the projected portions B have round cross-sectional shapes, the minutely divided vortexes are produced smoothly.

Second Embodiment

Figure 6:
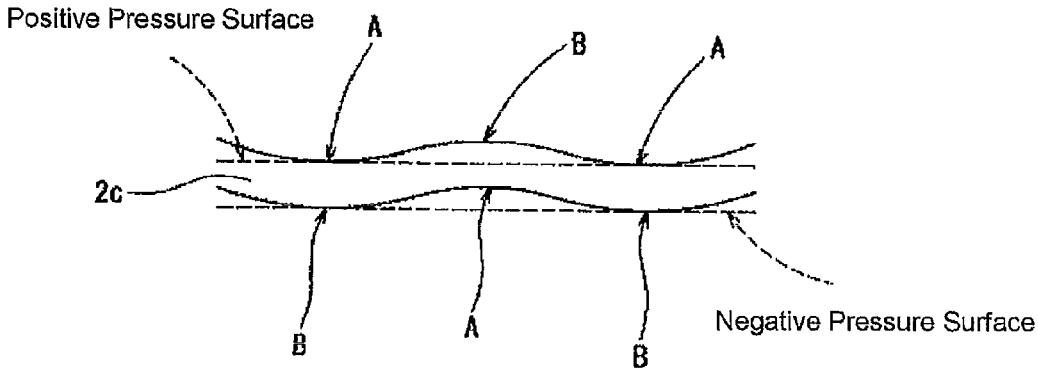
FIG. 6 is a partial cross-sectional view showing a blade of a propeller fan according to a second embodiment of the present invention.

A second embodiment of the present invention is different from the first embodiment in that the recessed portions A and the projected portions B of each blade tip 2*c* are formed by deforming portions of the blade tip 2*c* that are spaced apart at predetermined intervals in the direction in which the blade tip 2*c* extends in such a manner that these portions project toward the positive pressure surface of the blade 2 as illustrated in FIG. 6, instead of the negative pressure surface as illustrated in FIG. 4.

The second embodiment has the same advantages as the advantages of the above-described first embodiment.

Third Embodiment

Figure 7:
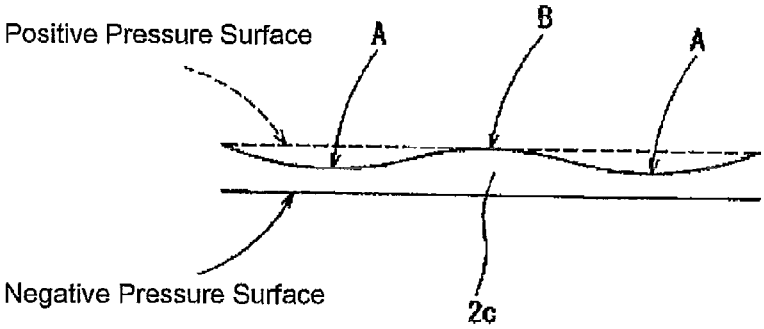
FIG. 7 is a partial cross-sectional view showing a blade of a propeller fan according to a third embodiment of the present invention.

A third embodiment of the present invention is different from the first embodiment in that the recessed portions A and the projected portions B of each blade tip 2*c* are formed by decreasing the thicknesses of portions of the blade tip 2*c* that are spaced apart at predetermined intervals in the direction in which the blade tip 2*c* extends compared to the other portions of the blade tip 2*c*, as illustrated in FIG. 7. More specifically, in the third embodiment, portions of the positive pressure surface corresponding to each blade tip 2*c* that are spaced apart at the predetermined intervals in the extending direction of the blade tip 2*c* are recessed compared to the other portions of the positive pressure surface corresponding to the blade tip 2*c*.

In the third embodiment, the recessed portions A and the projected portions B are formed in a portion of the positive pressure surface of each blade 2 corresponding to the blade tip 2*c*. In contrast, neither recessed portions A nor projected portions B are formed in a portion of the negative pressure surface of each blade 2 corresponding to the blade tip 2*c*. However, even in this case, the same advantages as those of the first embodiment are obtained. Further, the third embodiment is advantageous in that the weight of each blade 2 is easily reduced compared to the first and second embodiments.

Fourth Embodiment

Figure 8:
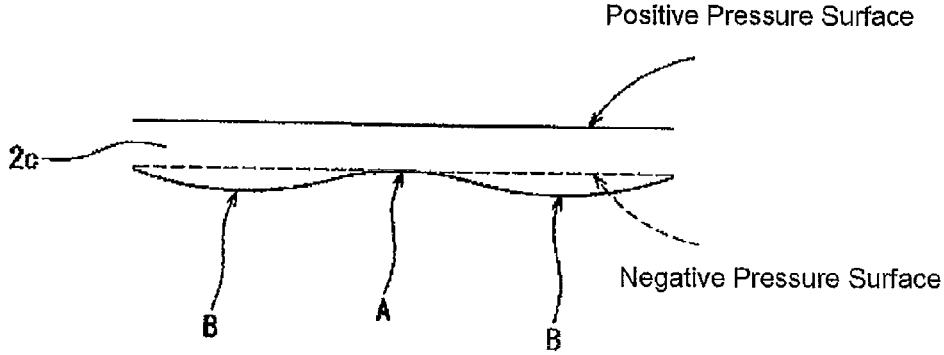
FIG. 8 is a partial cross-sectional view showing a blade of a propeller fan according to a fourth embodiment of the present invention.

A fourth embodiment of the present invention is different from the first embodiment in that the recessed portions A and the projected portions B of each blade tip 2*c* are formed by increasing the thicknesses of portions of the blade tip 2*c* that are spaced apart at predetermined intervals in the direction in which the blade tip 2*c* extends compared to the other portions of the blade tip 2*c*, as illustrated in FIG. 8. More specifically, in the fourth embodiment, portions of the negative pressure surface corresponding to each blade tip 2*c* that are spaced apart at the predetermined intervals in the extending direction of the blade tip 2*c* are projected compared to the other portions of the negative pressure surface corresponding to the blade tip 2*c*.

In the fourth embodiment, the recessed portions A and the projected portions B are formed in a portion of the negative pressure surface of each blade 2 corresponding to the blade tip 2*c*. In contrast, neither recessed portions A nor the projected portions B are formed in a portion of the positive pressure surface of each blade 2 corresponding to the blade tip 2*c*. However, even in this case, the same advantages as those of the first embodiment are obtained.

Fifth Embodiment

Figure 9:
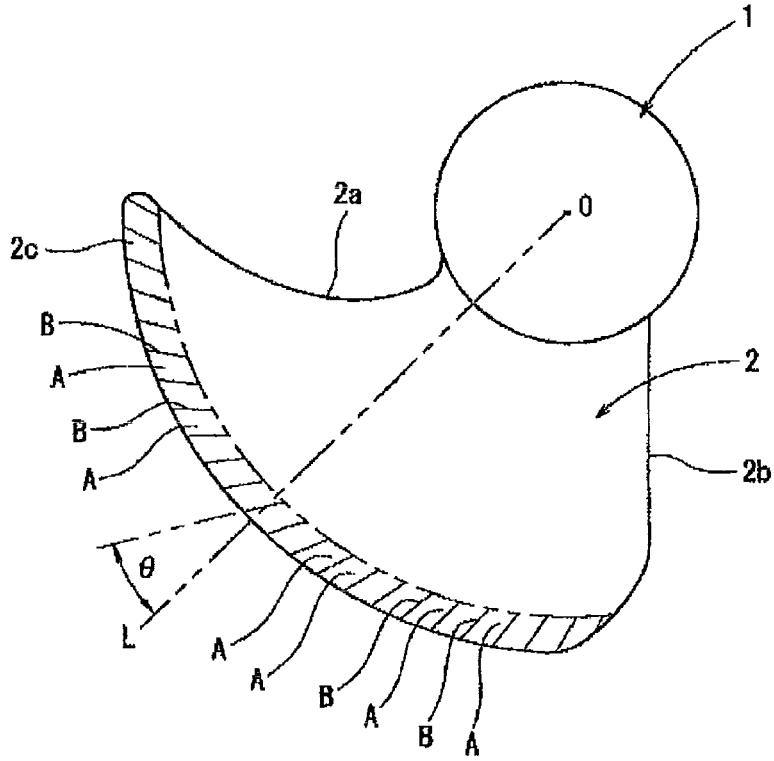
FIG. 9 is a rear view showing a blade of a propeller fan according to a fifth embodiment of the present invention, as viewed from the side corresponding to the blade negative pressure surfaces.

In a fifth embodiment of the present invention, the line extending along the deepest parts of each recessed portion A of each blade tip 2*c* is not parallel with a line connecting a point on the line along the deepest parts to the center of the hub 1, but is inclined with respect to this line at a predetermined angle θ in the rotational direction of the blade 2 (toward the leading edge 2*a*), as illustrated in FIG. 9. Similarly, the line extending along the highest parts of each projected portion B of the blade tip 2*c* is not parallel with a line connecting a point on the line along the highest parts to the center of the hub 1, but is inclined with respect to this line at the same angle θ in the rotational direction of the blade 2. The fifth embodiment is different from the first embodiment in the above-described points.

In the fifth embodiment, the blade tip vortexes are efficiently broken by the recessed portions A and the projected portions B of each blade tip 2*c* compared to the first embodiment.

Sixth Embodiment

Figure 10:
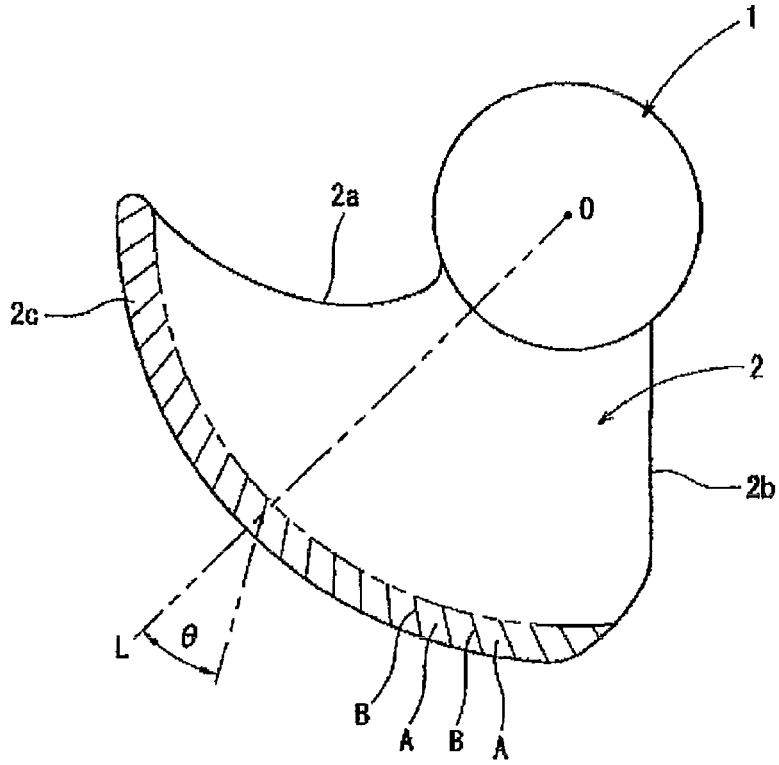
FIG. 10 is a rear view showing a blade of a propeller fan according to a sixth embodiment of the present invention, as viewed from the side corresponding to the blade negative pressure surfaces.

In a sixth embodiment of the present invention, the line extending along the deepest parts of each recessed portion A of each blade tip 2*c* is not parallel with a line connecting a point on the line along the deepest parts to the center of the hub 1, but is inclined with respect to this line at a predetermined angle θ in the direction opposite to the rotational direction of the blade 2 (toward the trailing edge 2*b*), as illustrated in FIG. 10. Similarly, the line extending along the highest parts of each projected portion B of the blade tip 2*c* is not parallel with a line connecting a point on the line along the highest parts to the center of the hub 1, but is inclined with respect to this line at the same angle θ in the direction opposite to the rotational direction of the blade 2. The sixth embodiment is different from the first embodiment in the above-described points.

In the sixth embodiment, as in the fifth embodiment, the blade tip vortexes are efficiently broken by the recessed portions A and the projected portions B of each blade tip 2*c* compared to the first embodiment.

Seventh Embodiment

Figure 11:
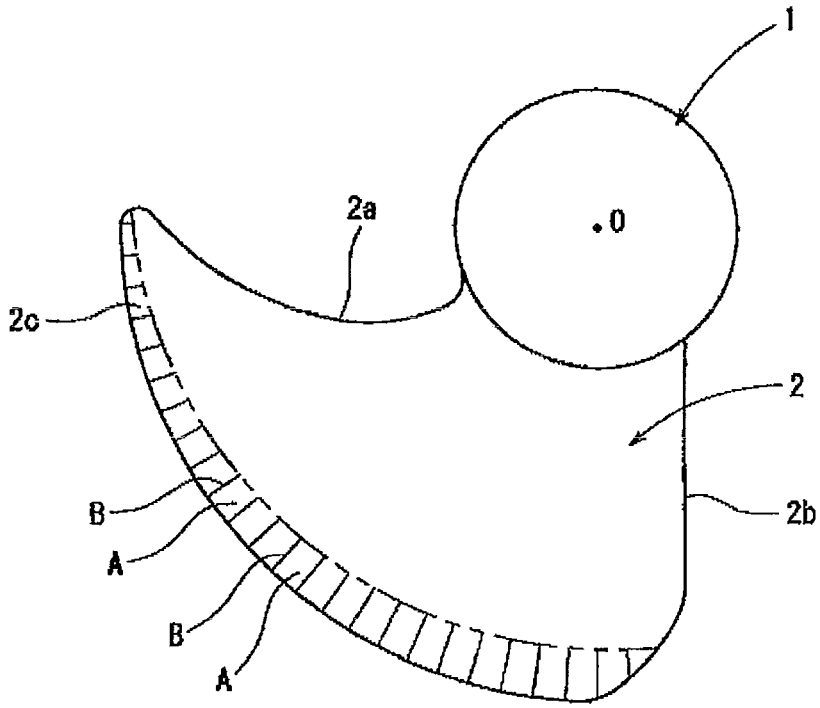
FIG. 11 is a rear view showing a blade of a propeller fan according to a seventh embodiment of the present invention, as viewed from the side corresponding to the blade negative pressure surfaces.

In a seventh embodiment of the present invention, the portion of each blade 2 having the corrugated shape has a width increasing toward the trailing edge 2*b*, as illustrated in FIG. 11, instead of the constant width along the direction in which the blade tip 2*c* extends. The seventh embodiment is different from the first embodiment in this point.

In the seventh embodiment, the portion of each blade 2 with the corrugated shape, which has the width increasing toward the trailing edge 2*b*, effectively suppresses generation of blade tip vortexes of scales enlarging toward the trailing edge 2*b*.

Eighth to Tenth Embodiments

Figure 12:
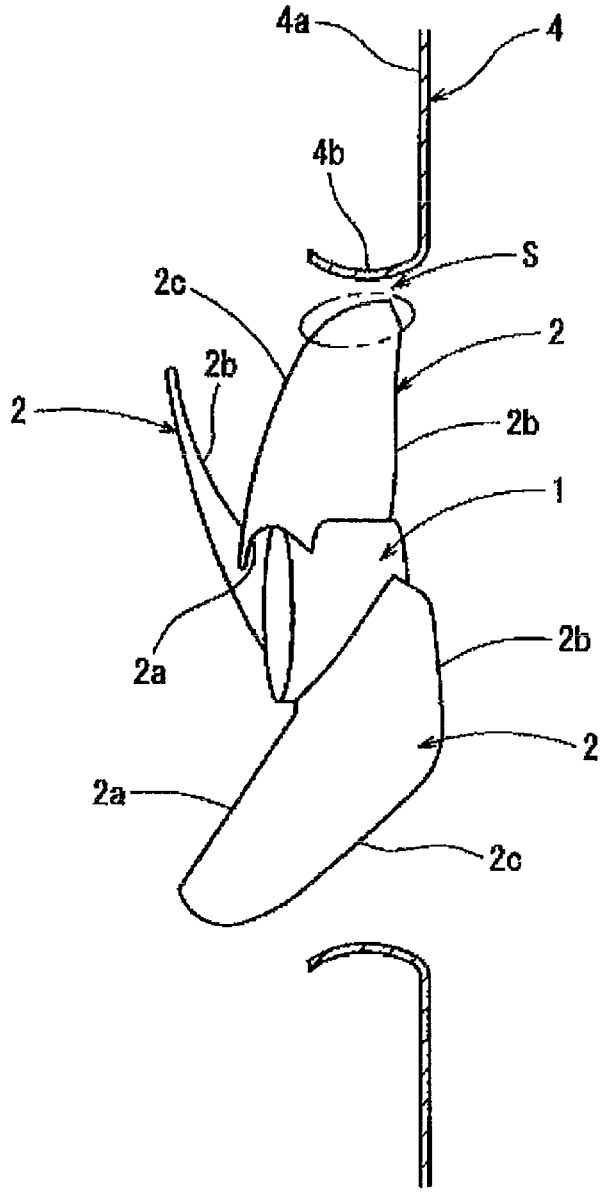
FIG. 12 is a central longitudinal cross-sectional view showing a propeller fan according to an eighth embodiment of the present invention.
Figure 13:
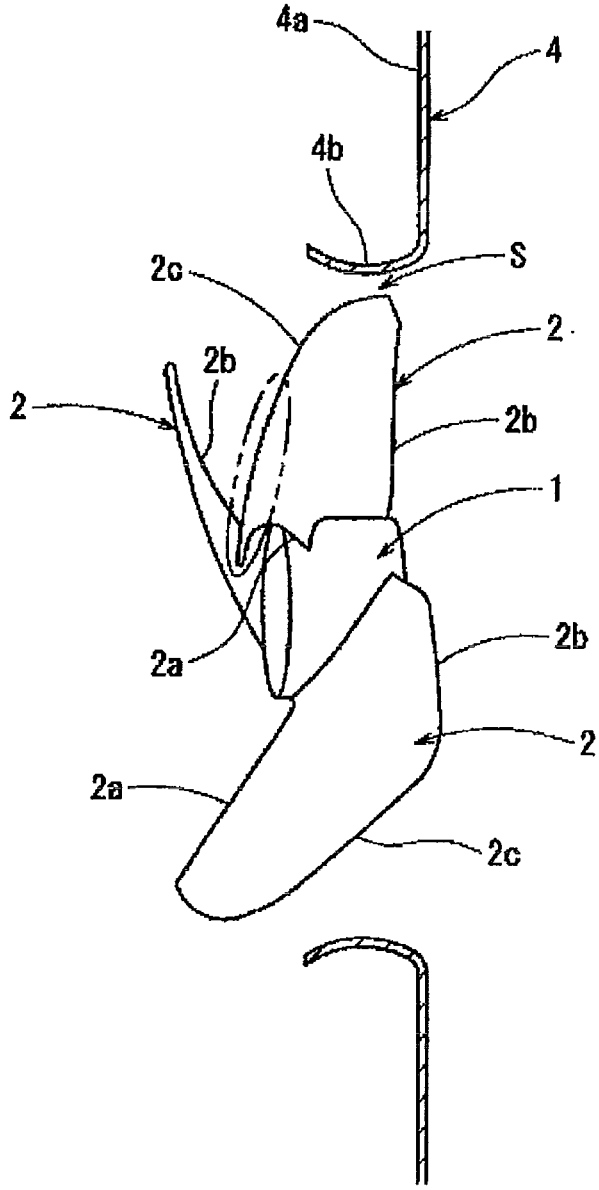
FIG. 13 is a central longitudinal cross-sectional view showing a propeller fan according to a ninth embodiment of the present invention.
Figure 14:
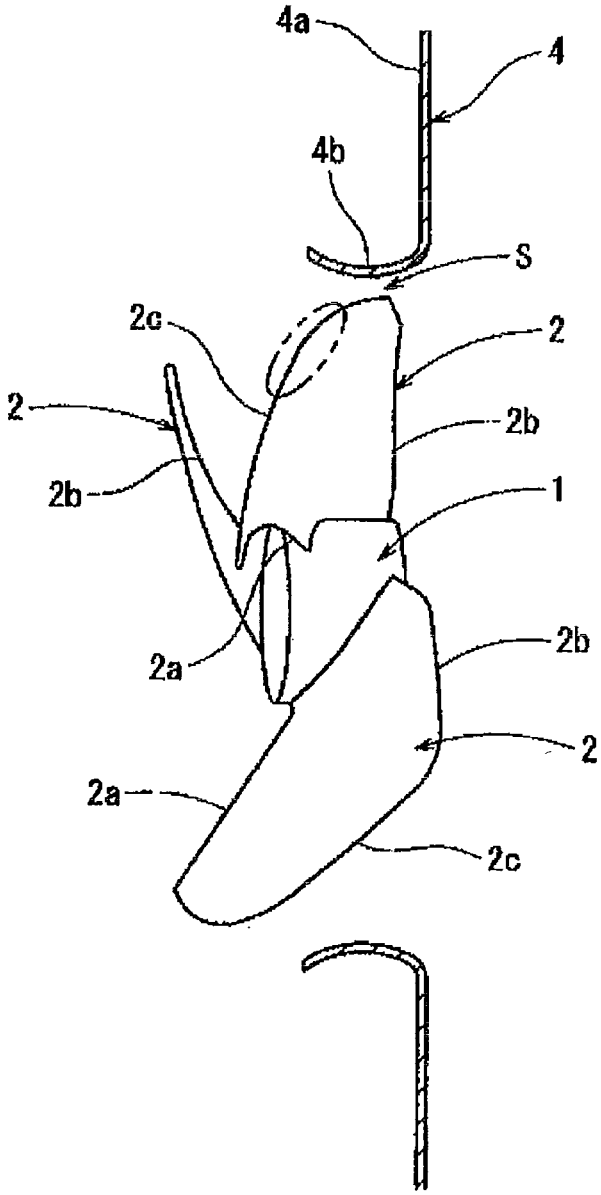
FIG. 14 is a central longitudinal cross-sectional view showing a propeller fan according to a tenth embodiment of the present invention.
Figure 15:
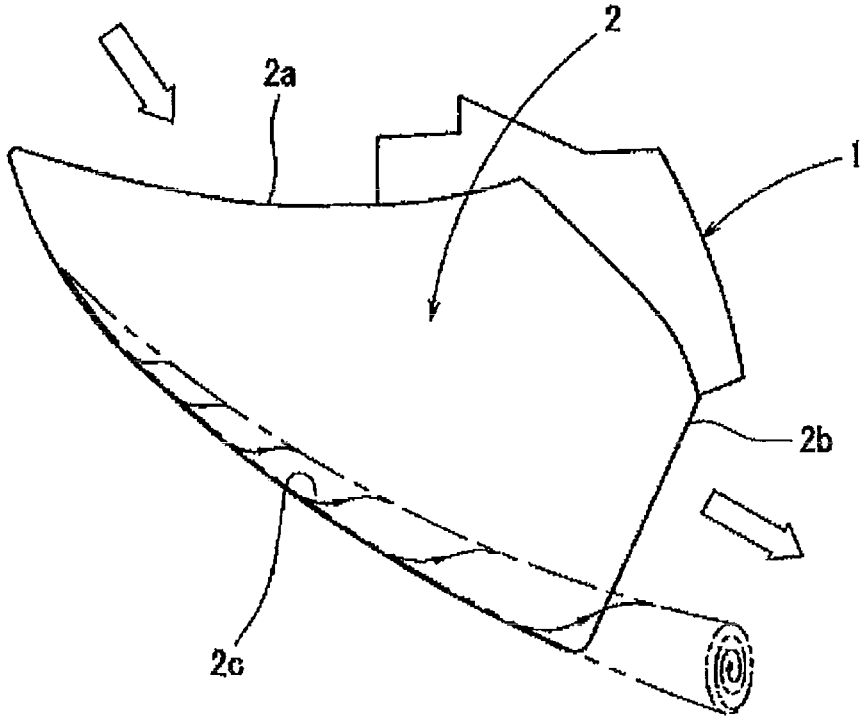
FIG. 15 is a perspective view showing a blade of a conventional propeller fan.

In eighth to tenth embodiments of the present invention, recessed portions A and projected portions B, which are alternately arranged in portions of the positive pressure surface and the negative pressure surface of each blade 2 corresponding to the blade tip 2*c*, are not formed continuously from the leading edge 2*a* to the trailing edge 2*b* in both of the positive pressure surface and the negative pressure surface of the blade 2. In the eighth embodiment, the recessed portions A and the projected portions B are alternately formed only in the portion of each blade tip 2*c* that corresponds to the guide portion 4*b* of the bellmouth 4, which is represented by the circle of the double-dotted line in FIG. 12. In the ninth embodiment, the recessed portions A and the projected portions B are alternately formed only in the portion of each blade tip 2*c* that does not correspond to the guide portion 4*b* of the bellmouth 4, which is represented by the circle of the double-dotted line in FIG. 13. In the tenth embodiment, the recessed portions A and the projected portions B are alternately formed only in the boundary between the portion of each blade tip 2*c* that corresponds to the guide portion 4*b* of the bellmouth 4 and the portion of the blade tip 2*c* that does not correspond to the guide portion 4*b* of the bellmouth 4, which boundary is represented by the circle of the double-dotted line in FIG. 14.

The eighth to tenth embodiments have the same advantages as the advantages of the first embodiment.

Obviously, the present invention may be employed in any type of propeller fans serving as axial flow fans, regardless of blade shapes, including shapes of forward swept blades and rearward swept blades, or the number of the blades.

What is claimed is:

1. A propeller fan comprising:

a hub;

a plurality of blades extending from the hub, each blade having a blade tip; and a bellmouth inside which the hub and the blades are arranged, the propeller fan being characterized in that recessed portions and projected portions are alternately formed in both of a positive pressure surface and a negative pressure surface of the blade tip of each blade by causing the blade tip to have a corrugated shape.

2. The propeller fan according to claim 1, wherein the recessed portions and the projected portions each have a round cross-sectional shape.

3. The propeller fan according to claim 1, wherein the recessed portions and the projected portions each have an angular cross-sectional shape.

4. The propeller fan according to claim 1, wherein the recessed portions and the projected portions are alternately formed along a direction in which the blade tip of each blade extends.

5. The propeller fan according to claim 1, wherein the portion of each blade in which the recessed portions and the projected portions are formed has a radial direction width increasing toward the trailing edge of the blade.

6. The propeller fan according to claim 1, wherein a first line extending along the deepest parts of each recessed portion is inclined with respect to a second line connecting a point on the first line to a center of the hub at a predetermined angle, and a third line extending along the highest parts of each projected portion is inclined with respect to a fourth line connecting a point on the third line to the center of the hub at the same angle.

* * * * *